US006149735A

United States Patent [19]

Ōue et al.

[11] Patent Number: 6,149,735

[45] Date of Patent: Nov. 21, 2000

[54] CHROMATE TREATMENT BATH COMPOSITION AND PROCESS FOR APPLICATION TO METALS

[75] Inventors: Takashi Ōue; Kensuke Mizuno, both of Hiratsuka, Japan

[73] Assignee: Henkel Corporation, Gulph Mills, Pa.

[21] Appl. No.: 09/077,502

[22] PCT Filed: Nov. 27, 1996

[86] PCT No.: PCT/US96/18555

§ 371 Date: Jun. 1, 1998

§ 102(e) Date: Jun. 1, 1998

[87] PCT Pub. No.: WO97/21845

PCT Pub. Date: Jun. 19, 1997

[30] Foreign Application Priority Data

Nov. 30, 1995 [JP] Japan ..... 7-312951

[51] Int. Cl.[7] ..... C23C 22/24

[52] U.S. Cl. ..... 148/267; 148/251; 106/14.44

[58] Field of Search ..... 148/251, 258, 148/259, 267; 106/14.44

[56] References Cited

U.S. PATENT DOCUMENTS

| | | | |
|---|---|---|---|
| 3,413,158 | 11/1968 | Inouye et al. | 148/251 |
| 4,475,957 | 10/1984 | Sander | 148/6.16 |
| 4,644,029 | 2/1987 | Cable et al. | 524/407 |
| 4,650,527 | 3/1987 | Ishii et al. | 148/258 |
| 4,671,825 | 6/1987 | Ishii et al. | 148/6.15 R |
| 4,683,157 | 7/1987 | Mosser et al. | 148/258 |
| 4,749,418 | 6/1988 | Saeki et al. | 148/6.16 |
| 4,810,742 | 3/1989 | Mundhenke | 524/411 |
| 4,944,802 | 7/1990 | Chagnon et al. | 106/20 |

FOREIGN PATENT DOCUMENTS

| | | | |
|---|---|---|---|
| 0177086 | 4/1986 | European Pat. Off. . | |
| 0214571 | 3/1987 | European Pat. Off. . | |
| 0485972 | 5/1992 | European Pat. Off. . | |
| 2117842 | 7/1972 | France . | |
| 58-022383 | 2/1983 | Japan . | |
| 61-058552 | 12/1986 | Japan . | |
| 62-083478 | 4/1987 | Japan . | |
| 63-096275 | 4/1988 | Japan . | |
| 7-033583 | 2/1995 | Japan . | |
| 1329198 | 12/1971 | United Kingdom . | |
| 2100741 | 1/1983 | United Kingdom . | |
| 2145118 | 3/1985 | United Kingdom | 148/251 |

OTHER PUBLICATIONS

Patent Abstracts of Japan 08 296054, published Nov. 12, 1996, Nippon Parkerizing CO Ltd.

Patent Abstracts of Japan 08 253873, published Oct. 1, 1996, Nippon Parkerizing CO Ltd.

*Primary Examiner*—John Sheehan

*Assistant Examiner*—Aldrew L. Oltmans

*Attorney, Agent, or Firm*—Wayne C. Jaeschke; Stephen D. Harper; Norvell E. Wisdom, Jr.

[57] ABSTRACT

A chromate treatment bath composition, afforded by the introduction, into an aqueous solution containing hexavalent Cr ions and trivalent Cr ions, of a nonionic-anionic composite surfactant that has an anionic moiety and a nonionic moiety composed of a polyethylene glycol group or a group consiting of an ethylene oxide addition polymer, provides metal surfaces onto which a layer of the composition containing 5 to 150 mg/m$^2$ of total chromium is dried with a chromate film that has an excellent alkali resistance and water resistance, a high chromium fixing ratio, an excellent corrosion resistance, and an excellent paint film adherence.

20 Claims, No Drawings

CHROMATE TREATMENT BATH COMPOSITION AND PROCESS FOR APPLICATION TO METALS

FIELD OF THE INVENTION

This invention relates to chromate treatment bath compositions and treatment methods for application to metals. More particularly, the present invention relates to a chromate treatment bath composition that, when dried into place on the surface being treated, can provide metal surfaces with a sparingly soluble chromate film that exhibits an excellent coatability with waterborne paints and at the same time has an excellent corrosion resistance, paint adherence, alkali resistance, and water resistance. The invention also relates to a treatment method using said chromate treatment bath composition.

DESCRIPTION OF RELATED ART

Unlike reactive chromate treatment technology and electrolytic chromate treatment technology, dry-in-place chromate treatment technology is able to form a chromate film on metals simply by coating the metals and then drying. As a result, a distinguishing feature of dry-in-place chromate treatment is that it is not limited to particular metal substrates. As a result, dry-in-place chromate treatment is frequently used to impart corrosion resistance to metal surfaces, to improve their adherence to resins, and most importantly to improve paint adherence and post-painting corrosion resistance when painting is carried out. At the present time the main metals used in flat sheet structures are zinciferous-plated steel sheet and aluminum and aluminum alloy flat sheet. These are widely used in such economic sectors as automotive applications, household electrical appliances, building materials, and so forth. These materials are almost inevitably subjected to a chromate treatment due to contemporary demands for high added value.

As stated above, a distinguishing feature of dry-in-place chromate treatment technology is that it is not limited to particular metal substrates. However, this technology has other advantages. Because a desirable film is obtained through just a simple application step, there is no specific requirement for long reaction times, and simple equipment can be used, so that the line length can be reduced. Moreover, the effluent treatment load is light because a post-treatment water rinse is not required. Also, because dry-in-place films usually contain a higher proportion of corrosion-inhibiting hexavalent chromium than do reactive chromate and electrolytic chromate films, dry-in-place chromate films can provide a higher corrosion resistance than the other two types at the same add-on weight.

However, the corrosion-inhibiting hexavalent chromium is soluble in the water in wet corrosive ambients, and as a result one drawback to dry-in-place chromate films is that they are generally more soluble in water than reactive or electrolytic chromate films. The main component exhibiting water solubility in dry-in-place chromate films is the hexavalent chromium ions, and films exhibiting a high water solubility of this type are denoted below as "low-fixed-chromium" films. As is well known, the hexavalent chromium ions is a pollutant, and this fact has generally created demand for a sparingly water soluble dry-in-place chromate film having a high proportion of fixed or immobilized chromium.

In addition to the problem of environmental pollution, the low proportion of fixed chromium in dry-in-place chromate films creates other problems for industrial application. One such problem is that the hexavalent chromium is eluted by alkaline degreasing processes. A degreasing step is generally required during the conversion of dry-in-place chromated metal stock into finished product in downstream channels in order to remove contaminants, such as oil, dust, iron powder, and the like, that have been picked up during various stages and of course during press forming. Since traditional solvent degreasing is in the course of being discontinued due to global environmental issues, waterborne degreasing, such as alkaline degreasing, normally must be employed for this purpose. The elution of a portion of the dry-in-place chromate film by alkaline degreasing requires the installation of special effluent treatment facilities in order to treat the hexavalent chromium ions in the spent degreasing bath from the degreasing process and in the rinse water used in the ensuing water rinse step.

Another problem occurs when waterborne resin coatings are applied on dry-in-place chromated stock. A very recent trend with flat sheet metal stock is that the stock is increasingly being painted with organic resin at the manufacturing stage, in order to obtain various characteristics, such as corrosion resistance, fingerprint resistance, lubricity, and insulating characteristics. Again in the case of organic resins, solvent-based resins are being replaced by waterborne resins for the same environmental reason as above. The hexavalent chromium ions eluted from dry-in-place chromate coatings inhibit dispersion of the waterborne resin in such waterborne resin coatings. This either prevents normal application and formation of the resin coating or ends up gelling the resin coating bath itself.

In summary, the reasons outlined above have prompted strong demand for the appearance of a dry-in-place chromate treatment bath that provides a sparingly water soluble film, i.e., a "high-fixed-chromium" film.

Dry-in-place chromate treatment baths generally take the form of $Cr^{3+}$-containing aqueous chromic acid or dichromic acid solutions, and several methods have already been proposed that provide sparingly water soluble dry-in-place chromate films using such baths.

Japanese Examined Patent Application [Kokoku] Number Sho 61-58552 [58,552/1986] discloses a method that uses a chromating bath based on chromic acid, chromic acid reduction product, and silica sol. However, the hexavalent chromium in the chromate film is still readily eluted when surface-treated steel sheet bearing a chromate film formed by this method is submitted, during processing and painting operations, to a pre-paint alkaline rinse. This causes the corrosion resistance of the film to decline.

Japanese Patent Application Laid Open [Kokai or Unexamined] Numbers Sho 58-22383 [22,383/1983] and Sho 62-83478 [83,478/1987] teach the use of silane coupling agent to reduce hexavalent chromium ions in the chromate treatment bath. In each case the coatings afforded by these methods have an excellent paint film adherence. However, the chromate film afforded by the former method has a poor alkali resistance, because it is laid down from a phosphoric acid-free chromate treatment bath. The chromate film afforded by the latter method also has a similarly inadequate alkali resistance.

Japanese Patent Application Laid Open [Kokai or Unexamined] Number Sho 63-96275 [96,275/1988] teaches a treatment method that uses a chromate treatment bath containing organic resin whose molecule has been functionalized with specific amounts of hydroxyl group. The alkali resistance is again often inadequate in this case because the organic resin in the chromate coating formed by this method contains carboxyl moieties produced by oxidation by chromic acid. In addition, the treatment bath stability in this case is strongly impaired because the reaction of the hydroxyl-functional organic resin and chromic acid proceeds even in the treatment bath itself.

Japanese Patent Publication [Kokoku] Number Hei 7-33583 [33,583/1995] teaches a chromate treatment method that uses a chromate treatment bath containing carboxylic acid and/or a carboxylic acid derivative. This chromate treatment bath affords only an inadequate improvement in application performance. In addition, because baking at 150° C. to 300° C. is required, this method entails substantial cost for its heating facilities, which runs counter to the current trend of economizing on energy. Thus, drying temperatures not exceeding 100° C. are desirable in order to fully exploit the overall merits of dry-in-place chromate treatment systems.

As has been described above, the prior dry-in-place chromate treatment baths and treatment methods have suffered from a number of drawbacks, and a dry-in-place chromate treatment bath and treatment method that would be free of these drawbacks has remained heretofore unknown. In other words, to date there has yet to appear a dry-in-place chromate treatment bath and corresponding treatment method that provide a good application performance and bath stability while also providing metal surfaces with a sparingly water soluble chromate film with a good alkali resistance, water resistance, corrosion resistance, and paint film adherence.

DESCRIPTION OF THE INVENTION

Object of the Invention

Taking this industrial situation into consideration, the present invention seeks to provide a chromate treatment bath composition and treatment process, for application to metals, that have a good application performance and bath stability and that also produce on the surface of the metal treated a sparingly water soluble (=high-fixed-chromium) chromate film with a good alkali resistance, water resistance, corrosion resistance, and paint film adherence.

SUMMARY OF THE INVENTION

It has been discovered that these problems can be solved by the addition of surfactant with a special structure to a chromate bath containing hexavalent chromium ions and trivalent chromium ions. The invention was achieved based on this discovery. In specific terms, a chromate treatment bath composition for application to metals according to the present invention characteristically comprises, preferably consists essentially of, or more preferably consists of:

(A) an aqueous chromate solution containing hexavalent chromium ions and trivalent chromium ions; and (B) a nonionic-anionic composite surfactant that has an anionic moiety and a nonionic moiety comprising at least 1 selection from polyethylene glycol groups and groups composed of ethylene oxide addition polymers in which at least 2 ethylene oxide molecules have been added in addition to a hydrophobe moiety.

In a preferred embodiment, the weight ratio of nonionic-anionic composite surfactant to hexavalent chromium ions concentration in a composition according to the present invention is from 0.1:1 to 2.0:1.

A chromate treatment bath composition according to the present invention can, and normally preferably does, also contain phosphate ions and silica, and may also contain other ingredients, such as fluorine-containing anions; soluble salts of metals, e.g., zinc, iron, nickel, aluminum, titanium, and zirconium; water-soluble polymers such as polyacrylic acids, maleic acid-methyl vinyl ether copolymers, polyacrylamides, and so forth; and acrylate ester copolymer emulsions, styrene-acrylate ester copolymer emulsions, epoxy resin emulsions, ethylene-acrylic acid copolymer emulsions, and polyester resin emulsions. In particular, the addition of an emulsion of an epoxy resin with a bisphenol skeleton is effective in increasing the paint adherence of the corresponding film. The above-described additive components may be added during preparation of the treatment bath. Bath stability considerations make it preferable that no silica be added when the bath contains fluorine ions or fluoride ions.

A method according to the present invention for chromate treatment of metal surfaces characteristically comprises forming and fixing a chromate film at a chromium add-on of 5 to 150 milligrams per square meter of surface treated, hereinafter usually abbreviated as "mg/m$^2$", measured as chromium metal, on the surface, by coating the surface with a layer of a chromate treatment bath composition according to the present invention and then drying the surface of the metal with this layer in place on the surface.

DETAILED DESCRIPTION OF THE INVENTION, INCLUDING PREFERRED EMBODIMENTS

The concentrations of hexavalent chromium ions and trivalent chromium ions in an aqueous inorganic chromate solution according to the invention are not critical. However, the total chromium ions concentration (hexavalent chromium ions+trivalent chromium ions) is preferably from 1 to 100 grams per liter (hereinafter usually abbreviated as "g/L"). At concentrations below 1 g/L, the corrosion resistance of the obtained coating can be unsatisfactory, unless a very thick layer of the bath is used, and controlling the drying of such a thick layer to avoid inconsistencies from one point to another on a treated surface is technically difficult. Concentrations above 100 g/L result in a high chromate bath viscosity and in addition reduce bath stability and thereby substantially hinder control of the chromium add-on to desired values.

The trivalent chromium ions/hexavalent chromium ions weight ratio is preferably in the range from 0.25 to 3.5. The hexavalent chromium content in the resulting film will be too high when this ratio falls below 0.25 and the film can exhibit an unsatisfactory water resistance. When this ratio exceeds 3.5 the hexavalent chromium content in the resulting film will be too low and the film can exhibit an inadequate corrosion resistance. The trivalent chromium ions/hexavalent chromium ions weight ratio can be controlled and adjusted by the addition of the usual reductants, such as ethanol, methanol, sucrose, and the like.

Molecules of the characteristic nonionic-anionic composite surfactant used in the present invention have a hydrophilic part and a hydrophobic part. The hydrophilic part has a composite structure that contains a nonionic moiety and a distinct anionic moiety. The nonionic moiety has a structure that contains at least one selection from polyethylene glycol groups and groups composed of ethylene oxide addition polymers in which at least two ethylene oxide molecules have been added, or in other words contains a moiety conforming to the general formula —$(C_2H_4O)_n$—, where n is a positive integer with a value of at least two. Surfactants whose molecules contain such a nonionic moiety and a distinct anionic moiety in one hydrophilic group are called "nonionic-anionic composite surfactants" within the context of the present invention.

The surfactant used in the present invention must have the structure described above for the composite hydrophilic group, but is not otherwise narrowly restricted, and any single selection or plural number of selections from the above-described nonionic-anionic composite surfactants can be used in the present invention. In a more preferred embodiment, the special nonionic moiety in the composite hydrophilic part is bonded to the hydrophobic part through a non-ester linkage.

Nonionic-anionic composite surfactants used by the present invention are exemplified by compounds in which a molecule of a hydrophilic acid with at least two ionizable hydrogen atoms, such as sulfuric acid, phosphoric acid, carbonic acid, and the like, has been bonded to a nonionic surfactant molecule by one or more bonds that replace less than all of the ionizable hydrogen atoms of the hydrophilic acid, as illustrated below. Salts of such compounds can also be used as the nonionic-anionic composite surfactant.

The following are provided as examples of nonionic surfactant containing a hydrophobic part and a nonionic hydrophilic part that can serve as a precursor for a nonionic-anionic composite surfactant needed in a composition of the present invention:

(1) ethylene oxide adducts of (i) higher alcohols, (ii) fatty acids, (iii) fatty acid esters of polyhydric alcohols, (iv) higher alkylamines, (v) fatty acid amides, and (vi) polypropylene glycol;

(2) ethylene oxide adducts of phenol, alkylphenols, styrenated phenol, and polycyclic aromatic compounds (e.g., naphthalene, anthracene, etc.); and (3) ethylene oxide adducts of condensates between (i) an aldehyde (e.g., formaldehyde or acetaldehyde) or a ketone (e.g., acetone or methyl ethyl ketone) and (ii) a polycyclic aromatic compound, styrenated phenol compound, polyvinylphenol, or phenolic compound.

Among the preceding nonionic surfactants, ethylene oxide adducts of higher alcohols and the ethylene oxide adducts of alkylphenols are preferred for their ease of commercial acquisition.

A nonionic-anionic composite surfactant effective in the present invention can be obtained by reacting a hydrophilic acid, e.g., sulfuric acid, phosphoric acid, or carbonic acid, with a nonionic hydrophilic group-functionalized surfactant as described above to yield the anionic sulfate ester ($—OSO_3H$), sulfonic acid ($—SO_3H$), phosphate ester ($—OPO_3H$), or carboxylic acid (—COOH) or salt thereof.

A nonionic-anionic composite surfactant used in the present invention can also be a reactive nonionic-anionic composite surfactant that contains, in addition to the aforesaid nonionic and anionic moieties, at least one carbon—carbon double bond (C═C) in each molecule. Such reactive surfactants are exemplified by the surfactants afforded by the addition of a double bond-containing group (e.g., $—CH═CHCH_3$ or $—CH_2OCH_2CH═CH_2$) to the ethylene oxide adduct of an alkylphenol and by the corresponding salts afforded by neutralization with ammonia.

The weight ratio of the nonionic-anionic composite surfactant concentration to the hexavalent chromium ions concentration in a treatment bath composition according to the present invention is preferably from 0.1:1 to 2.0:1. When this weight ratio exceeds 2.0:1, the resulting chromate film can exhibit an unsatisfactory adherence to paint films. When this weight ratio falls below 0.1:1, the effect on the resulting film from the addition of the nonionic-anionic composite is usually inadequate.

Phosphate ions are also preferably present in a chromate treatment bath composition according to the present invention. Specifically, a phosphate ions/total chromium ions weight ratio of from 0.1 to 2.0 is preferred, and for purposes of calculating this ratio, the stoichiometric equivalent as orthophosphate ions (i.e, $PO_4^{-3}$) of all inorganic acids that contain phosphorus in its +5 valence state and all salts thereof added to the composition in the course of preparing it is considered to be present as phosphate ions, irrespective of the actual degree of ionization that may exist in the composition. When this ratio is below 0.1, the resulting chromate film tends to have a lower alkali resistance and corrosion resistance than are desirable. When this ratio exceeds 2.0, reduction of the hexavalent chromium ions by the subject nonionic-anionic composite surfactant readily proceeds to excess in the bath. As a result, a majority of the hexavalent chromium ions in the chromate bath ends up being reduced to trivalent chromium ions prior to application, and the chemical stability of the chromate bath may become unacceptable.

Silica is also preferably present in a chromate treatment bath composition according to the present invention. The effects from silica addition are, for example, improvements in the corrosion resistance, paint adherence, and scratch resistance of the resulting chromate film. The preferred silica sol content corresponds to a silica sol/total chromium ions weight ratio (solids) of from 0.2 to 6.0. The effects from addition may be inadequate when this weight ratio is below 0.2. When this ratio exceeds 6.0, the effects from silica addition become saturated and such additions are thus economically undesirable. Furthermore, such additions can cause an unacceptably low water-resistant secondary adherence to a paint film after painting.

Silica used in the present invention preferably is selected from the group consisting of colloidal silicas, silica sols, and fumed silicas, in each case with a particle size of 5 to 300 nanometers (hereinafter usually abbreviated as "nm"). Irregularities in the film surface may be produced when the film is prepared using a treatment bath that contains silica with a particle size in excess of 300 nm. This can impair the gloss aspect of the appearance. In the case of a coating treatment bath containing silica sol with a particle size below 5 nm, the specific surface of the silica sol becomes so large that bath stability can be impaired.

A chromate treatment bath composition for metals according to the present invention also preferably contains fluorine ions or fluoride ions. The source of said fluorine ions or fluoride ions is not critical, but is preferably hydrofluoric acid or a complex hydrofluoric acid such as fluosilicic acid, fluozirconic acid, or fluotitanic acid. The fluorine ions/total chromium ions weight ratio is preferably from 0.01 to 1.0. When this weight ratio is below 0.01, the etching activity may be undesirably weak, so that removal of the metal oxides from treated metal surfaces will be inadequate. On the other hand, at values in excess of 1.0, the etching activity becomes so strong that the corrosion resistance of the treated metal is diminished.

The metal substrate on which a chromate treatment according to the invention may be executed is not narrowly restricted, but steel sheet commercially plated with zinc or zinc alloy, aluminum, and/or aluminum alloys is particularly suitable.

The chromium add-on from application of a chromate treatment bath composition according to the present invention is also not narrowly restricted, but the preferred range for the chromium add-on on the metal surface is from 5 to 150 $mg/m^2$ (as chromium metal). A chromium add-on below 5 mg/m$^2$ often causes the resulting chromate film to have an inadequate corrosion resistance. A chromium add-on in excess of 150 mg/m$^2$ reduces the improvement in chromium fixing ratio afforded by the present invention. Moreover, an excessively thick chromate coating raises the possibility of a deterioration in the physical properties of the film due to, for example, cracking during drying. The pH of the treatment bath composition according to the present invention is also not particularly critical, but as a general rule is preferably maintained below 3.0.

The method for drying the subject coated chromate layer is also not particularly critical, and the drying method can be selected from hot air-current drying, high-frequency induction heating, and so forth. The drying temperature after application of the subject chromate treatment bath composition is again not critical, but metal sheet temperatures in the range from 60° C. to 150° C. are preferred. Sheet temperatures below 60° C. usually cause a diminished productivity due to the long times required for the reaction between the hexavalent chromium and nonionic-anionic composite surfactant. High sheet temperatures, in excess of 150° C., are uneconomical due to the associated increase in equipment costs.

It is believed, without limiting the invention, that a hydration layer is formed by water molecules around the nonionic moiety of the hydrophilic part of the nonionic-anionic composite surfactant molecules present in a composition according to the invention and that this hydration layer protects against or deflects the strong oxidizing activity of the hexavalent chromium ions, which otherwise would be expected to react rapidly with an easily oxidized material such as polyethylene oxide. In addition, the hexavalent chromium ions are known to be present in the treatment bath as the chromate ions or dichromate ions, that is, as anions. This results in the development of electrostatic repulsion between the nonionic-anionic composite surfactant molecules in the aqueous solution, which further inhibits oxidation of the surfactant by the hexavalent chromium ions. These effects apparently make it possible for the nonionic-anionic composite surfactant to be stably present in the chromate treatment bath even in the presence of the strong oxidizing activity of the hexavalent chromium ions.

A chromate treatment bath composition according to the present invention may also contain silica. At a pH below 3.0, silica is thought to be anionic, however weakly. Aggregation and sedimentation of the silica particles is thus militated against by electrostatic repulsion from the nonionic-anionic composite surfactant present in the chromate bath.

As described above, the nonionic-anionic composite surfactant is stably present in the chromate treatment bath composition according to the present invention at ambient temperatures. However, during drying at elevated temperatures, it is believed to undergo oxidative decomposition and function during this process to reduce hexavalent chromium ions to trivalent chromium ions. Since a large amount of hydrogen ions is required for the reduction of hexavalent chromium ions to trivalent chromium ions, this reaction is expected to be accompanied by an increase in pH, with the result that the sparingly soluble trivalent chromium ions thus formed are insolubilized in the newly modified chromate film. Thus, the nonionic-anionic composite surfactant is thought to contribute to an improved chromium fixing ratio through its reduction of hexavalent chromium ions to trivalent chromium ions.

The nonionic-anionic composite surfactant also functions to reduce the surface tension of the chromate treatment bath composition according to the present invention. Chromate treatment generally involves application of the chromate treatment bath composition to metal followed by drying. When a high surface tension chromate treatment bath composition is applied, the variation or unevenness produced during application is directly converted into coating irregularities by drying; this is a problem for the appearance. However, a chromate treatment bath composition according to the present invention has a low surface tension and application inhomogeneities are rapidly extinguished after application to the metal. Accordingly, post-drying application irregularities become insignificant and the coated sheet will have an excellent appearance. Thus, the subject nonionic-anionic composite surfactant also functions to improve the application performance of a chromate treatment bath composition according to the present invention.

If the chromate treatment bath composition according to the present invention exhibits high foaming due to the activity of the surfactant contained therein, the foaming can be reduced by the addition of an antifoam agent as generally known in the art.

Further appreciation of the invention may be achieved by consideration of the following working and comparative examples, but the invention is not limited to these examples.

EXAMPLES 1 TO 17 AND COMPARATIVE EXAMPLES 1 TO 3

(1) Preparation of the Chromate Treatment Baths

Chromate treatment bath A with the composition given in Table 1 was prepared by the following procedure. First, 50 grams (hereinafter usually abbreviated as "g") of chromic anhydride was dissolved in 500 g of water. Methanol was then added to the aqueous solution to reduce a portion of the chromic acid and give a hexavalent chromium ions/trivalent chromium ions weight ratio of 7/3. The surfactant was preliminarily dissolved in water to give an aqueous solution that was added to the aqueous solution containing hexavalent chromium ions and trivalent chromium ions, and the result was brought to a total of 1 kg by the addition of water. The chromate treatment baths B to H and J to N reported in Table 1 were each prepared with the compositions reported in Table 1, using the same general procedure as for chromate treatment bath A, but with different amounts and types of material where so specified.

(2) Preparation of the Test Specimens

Test specimens were prepared by the following treatment sequence:

workpiece (note 1)→alkaline degreasing (note 2)→water rinse→roll squeegee→drying (air-current drying) →application of the dry-in-place chromate bath (note 3)→drying (note 4).

Notes on the treatment sequence (1) The workpieces were:

1. commercial electrogalvanized steel sheet (hereinafter usually abbreviated as "EG")
2. commercial hot-dip galvanized steel sheet (hereinafter usually abbreviated as "GI")
3. commercial galvannealed hot-dip galvanized steel sheet (hereinafter usually abbreviated as "GA")
4. commercial 5% aluminum-zinc-plated steel sheet (hereinafter usually abbreviated as "GF")
5. pure aluminum sheet (hereinafter usually abbreviated as "Al").

In each case the dimensions of the workpiece were 200×300 mm with a sheet thickness of 0.6 to 0.8 mm.

(2) In the case of the galvanized steel sheet (EG, GI, GA, and GF), alkaline degreasing consisted of treatment at 60° C. by spraying for 30 seconds with a 2% aqueous solution of PALKLIN™ 342 weakly alkaline degreaser (commercially available from Nihon Parkerizing Co., Ltd.). In the case of the aluminum sheet, alkaline degreasing consisted of treatment at 60° C. by spraying for 2 minutes with a 2% aqueous solution of FINECLEANER™ 4327 nonetching degreaser (commercially available from Nihon Parkerizing Co., Ltd.).

TABLE 1

THE CHROMATE TREATMENT BATHS

PART 1: EXAMPLES

| Ingredient and Measurement | Value for Bath Composition Identified with Letter: | | | | | | | |
|---|---|---|---|---|---|---|---|---|
| Units | A | B | C | D | E | F | G | H |
| $Cr^{6+}$, g/kg | 18.2 | 18.2 | 18.2 | 18.2 | 18.2 | 18.2 | 13.0 | 7.8 |
| $Cr^{3+}$, g/kg | 7.8 | 7.8 | 7.8 | 7.8 | 7.8 | 7.8 | 13.0 | 18.2 |
| $Cr^{3+}/Cr^{6+}$ Ratio | 3/7 | 3/7 | 3/7 | 3/7 | 3/7 | 3/7 | 5/5 | 7/3 |
| $PO_4^{3-}$, g/kg | 0 | 5.2 | 0 | 0 | 5.2 | 2.6 | 5.2 | 32.0 |
| HF, g/kg | 0 | 0 | 1.0 | 0 | 0 | 1.0 | 0 | 0 |
| $SiO_2$, g/kg | 0 | 52 | 0 | 52 | 26 | 0 | 0 | 52 |
| Surf. | I | I | II | II | I | I | I | II |
| Surf./$Cr^{6+}$ Ratio | 0.5 | 0.5 | 0.5 | 1.0 | 0.5 | 1.0 | 0.5 | 0.5 |

Abbreviations and Other Notes for Table 1
"g/kg" means "grams of ingredient per kilogram of total composition;
"Surf." means "Surfactant".
The $SiO_2$ used was SNOTEX ™ O obtained from Nissan Kagaku Kabushiki Kaisha.
The following surfactants were used and are identified in the Table by the number shown for each surfactant below:
For the Examples
I) ammonium salt of polyoxyethylene styrenated phenyl ether sulfate, from Nippon Nyukazai Kabushiki Kaisha;
II) soduim salt of polyoxyethylene nonylphenyl ether phosphate, from Toho Kagaku Kogyo Kabushiki Kaisha;
For the Comparison Examples
III) sodium lauryl sulfate, from Toho Kagaku Kogyo Kabushiki Kaisha;
IV) sodium dodecylbenzenesulfonate, from Toho Kagaku Kogyo Kabushiki Kaishi;
V) polyoxyethylene nonylphenyl ether, from Dai-ichi Kogyo Seiyaku Kabushiki Kaishi.
The Surfactant/$Cr^{6+}$ ratio is based on active surfactant solids only.

PART 2: COMPARATIVE EXAMPLES

| Ingredient and | Value for Bath Composition Identfied with Letter: | | | | |
|---|---|---|---|---|---|
| Measurement Units | J | K | L | M | N |
| $Cr^{6+}$, g/kg | 18.2 | 18.2 | 18.2 | 13.0 | 18.2 |
| $Cr^{3+}$, g/kg | 7.8 | 7.8 | 7.8 | 13.0 | 7.8 |
| $Cr^{3+}/Cr^{6+}$ Ratio | 3/7 | 3/7 | 3/7 | 5/5 | 3/7 |
| $PO_4^{3-}$, g/kg | 5.2 | 0 | 0 | 5.2 | 5.2 |
| HF, g/kg | 0 | 2.0 | 0 | 0 | 0 |
| $SiO_2$, g/kg | 26 | 0 | 26 | 0 | 26 |
| Surf. | III | IV | — | IV | V |
| Surf./$Cr^{6+}$ Ratio | 0.5 | 1.0 | — | 1.0 | 1.0 |

(3) The dry-in-place chromate treatment bath was used diluted with water to a total chromium ions concentration (hexavalent chromium ions+trivalent chromium ions) of 13.0 g/L. It was applied using a groove roll at a chromium add-on (after drying) of 30, 50, or 100 mg/$m^2$ (controlled by adjusting the downward pressure of the applicator roll).

(4) Drying consisted of achieving a maximum sheet temperature of 100° C. in a hot air-current oven.

(3) Performance Tests (A) Chromium elution tests (A)-1 Test of water solubility of the chromate film immediately after the chromate treatment.

Immediately after drying, a portion but only a portion of the test specimen chromated as described above was immersed in deionized water at room temperature. The immersed region was then dried in an air current. The chromium add-on (mg/$m^2$) in both the immersion region and immersion-free region was measured by fluorescent X-ray analysis. The water solubility of the chromate film in this procedure, denoted below as the "quick leach resistance", was evaluated from the following equation: quick leach resistance, %=100(A−B)/A, where A=the chromium add-on of the region not immersed in water and B=chromium add-on of the region immersed in water. Smaller values indicate a better quick leach resistance and the formation of a more sparingly water-soluble chromate film.

(A)-2 Test of alkaline elution of the chromate film.

The test specimen treated as described above was sprayed for 2 minutes at 60° C. with a 2% aqueous solution of PALKLIN™ N364S moderately alkaline degreaser (commercially available from Nihon Parkerizing Co., Ltd.). The chromium add-on (mg/$m^2$) was measured by fluorescent X-ray analysis both before and after this treatment, and the alkaline elution was calculated using the following equation:

$$\text{alkali resistance, } \%=100(A'-B')/A'$$

where A'=chromium add-on before alkaline cleaning and B'=chromium add-on after alkaline cleaning. Smaller values indicate a better alkali resistance and the formation of a chromate film more resistant to dissolution by alkali.

(B) Bare corrosion resistance test

Test specimens treated as described above were submitted to salt-spray testing according to Japanese Industrial Standard Z-2371 using different test times for the different materials: 200 hours for the EG and GI specimens, 120 hours for the GA specimens, 300 hours for the GF specimens, and 200 hours for the Al specimens. The area of rust development on the test specimens was visually evaluated and reported using the following scale:

excellent 5: area of rust development less than 5%;

↑4: area of rust development from 5 to <10%;

↑3: area of rust development from 10 to <15%;

↑2: area of rust development from 15 to <25%;

poor 1: area of rust development is 25% or more.

(C) Paint performance

The test specimen treated as described above was bar coated with DELICON™ #700 melamine-alkyd paint (commercially available from Dai Nippon Toryo Co., Ltd.) so as to give a paint film thickness of 25 micrometers. This was followed by baking at 140° C. for 30 minutes to yield a painted sheet. This painted sheet was submitted to the following paint performance tests.

(C)-1 Primary adherence

A grid of 100 squares (1 mm×1 mm) was scribed into the painted surface using a knife cutter. The grid region was then extruded 5 mm using an Erichsen tester and thereafter peeled with cellophane tape. The number of remaining squares was counted for the evaluation.

(C)-2 Secondary adherence

After immersion for 4 hours in boiling water, the painted surface of the painted sheet was scribed with a grid of 100 squares (1 mm×1 mm) using a knife cutter. The grid region was then extruded 5 mm using an Erichsen tester and thereafter peeled with cellophane tape. The number of remaining squares was counted for the evaluation.

In these (C)-1 and (C)-2 tests, a larger number of residual paint film squares indicates a better paint film adherence.

(D) Application performance of the chromate treatment bath

The coating appearance on the surface of the test specimen treated as described above was evaluated and reported using the following scale:

excellent ++: no application irregularities observed;

+: very slight application irregularities observed;

poor x: conspicuous application irregularities observed.

(E) Chemical stability test

Each treatment bath described in Table 1 was held at room temperature for one month, after which time the appearance of the bath was visually inspected and reported on the following scale:

excellent ++: no change;

+: appearance of a very small amount of sediment;

poor x: appearance of sediment and suspended material.

(F) Test of coatability with waterborne resin

The test specimens fabricated as above were bar coated with ARONMELT™ waterborne polyester resin (commercially available from Toa Gosei Kabushiki Kaisha) so as to give a resin film thickness of 1.0 micrometer. This was followed by drying in a hot air-current oven to a maximum attained sheet temperature of 100° C. The status of the coating was then evaluated on the following scale:

excellent ++: the waterborne resin was uniformly coated;

+: although no gel was observed from the waterborne resin on the coated surface, unevenness in application was produced;

Δ: small amounts of gel from the waterborne resin were produced on the surface of the coated sheet;

poor x: the waterborne resin had gelled and large amounts of gel were produced on the sheet surface.

Table 2 below reports the test results from the various performance tests and Table 3 below reports the results of the chemical stability tests of the chromate treatment baths in Table 1.

As demonstrated by the results in Table 2, the use of chromate treatment bath compositions (see Table 1) and the treatment method according to the present invention (Examples 1 to 17) provided an excellent resistance to chromium elution from the films (quick leach resistance and alkali resistance), unproblematic coating with waterborne resin, an excellent coating appearance of the chromate treatment bath itself, and a satisfactory paint performance and bare corrosion resistance. Moreover, the chromate treatment baths (bath compositions A to H) used in the performance tests had good chemical stabilities.

TABLE 2

RESULTS FROM THE PERFORMANCE TESTS

| | | | | % Chromium Eluted by: | | Rating from Test for: | | | | |
|---|---|---|---|---|---|---|---|---|---|---|
| | | | | | | Coating | Waterborne | | | Bare |
| | | Chromate | Cr Add-on, | Quick | Alkaline | Perform- | Resin | Paint Adherence | | Corrosion |
| Number | Substrate | Bath | mg/m$^2$ | Leach | Cleaning | ance | Coatability | Primary | Secondary | Resistance |
| Ex 1 | 1-EG | A | 100 | 13 | 10 | ++ | + | 96 | 94 | 5 |
| Ex 2 | 2-GI | A | 100 | 12 | 11 | ++ | + | 96 | 95 | 5 |
| Ex 3 | 1-EG | B | 100 | 12 | 10 | ++ | ++ | 100 | 98 | 5 |
| Ex 4 | 3-GA | B | 50 | 9 | 8 | ++ | ++ | 100 | 98 | 5 |
| Ex 5 | 4-GF | B | 30 | 5 | 4 | ++ | ++ | 100 | 97 | 5 |
| Ex 6 | 1-EG | C | 100 | 14 | 10 | ++ | + | 95 | 94 | 5 |
| Ex 7 | 3-GA | C | 100 | 11 | 9 | ++ | ++ | 96 | 94 | 5 |
| Ex 8 | 2-GI | D | 50 | 10 | 8 | ++ | ++ | 100 | 97 | 5 |
| Ex 9 | 4-GF | D | 30 | 6 | 4 | ++ | ++ | 100 | 97 | 5 |
| Ex 10 | 1-EG | E | 50 | 13 | 10 | ++ | ++ | 100 | 96 | 5 |
| Ex 11 | 2-GI | E | 50 | 8 | 6 | ++ | ++ | 100 | 97 | 5 |
| Ex 12 | 2-GI | F | 100 | 9 | 8 | ++ | ++ | 97 | 95 | 5 |
| Ex 13 | 3-GA | F | 100 | 14 | 11 | ++ | + | 96 | 94 | 5 |
| Ex 14 | 1-EG | G | 100 | 9 | 8 | ++ | ++ | 97 | 94 | 5 |
| Ex 15 | 2-GI | H | 30 | 5 | 3 | ++ | ++ | 100 | 97 | 5 |
| Ex 16 | 5-Al | A | 100 | 13 | 12 | ++ | + | 99 | 95 | 5 |
| Ex 17 | 5-Al | D | 50 | 10 | 8 | ++ | ++ | 98 | 95 | 5 |
| CE 1 | 2-GI | L | 100 | 33 | 48 | + | x | 99 | 97 | 5 |
| CE 2 | 1-EG | L | 50 | 39 | 56 | + | Δ | 99 | 96 | 4 |
| CE 3 | 3-GA | N | 50 | 11 | 10 | ++ | + | 97 | 95 | 5 |

Abbreviations for Table 2

"Ex" means "Example"; "CE" means "Comparative Example".

TABLE 3

| RESULTS OF THE CHEMICAL STABILITY TESTS | | | | | | | | | | | | |
|---|---|---|---|---|---|---|---|---|---|---|---|---|
| A | B | C | D | E | F | G | H | J | K | L | M | N |
| ++ | ++ | ++ | ++ | ++ | ++ | ++ | ++ | x | x | ++ | x | + |

Notes for Table 3
The chemical stability rating for each chromate treatment bath identified by letter in Table 1 is shown under the corresponding letter in Table 3.

Bath compositions J, K, and M used surfactants with chemical structures differing from that according to the present invention, and in each case were unstable to the strong oxidizing activity of the hexavalent chromium ions and thus had such poor chemical stabilities that their other performance characteristics could not practically be evaluated. Surfactant-free bath composition L (Comparative Examples 1 and 2) did have a good chemical stability, but it gave a resistance to chromium elution that was inferior to that afforded by chromate treatment bath compositions according to the present invention, did not provide good coatability by waterborne resin, and did not provide a satisfactory coating appearance by the chromate treatment bath itself. Bath composition N, whose surfactant lacked an anionic moiety, had a chemical stability lower than the chromate compositions in the examples.

BENEFITS OF THE INVENTION

The invention described above produces an excellent coating appearance, decreases elution of Cr(VI) from the chromate film, provides excellent coating by waterborne resins, is chemically stable, and provides coatings with high quality corrosion resistance either bare or painted.

The invention claimed is:

1. An aqueous liquid chromate treatment bath composition suitable for application to metals as a dry-in-place treatment, said composition comprising water and:

(A) an amount of dissolved hexavalent chromium ions;

(B) an amount of dissolved trivalent chromium ions; and (C) an amount of a dissolved nonionic-anionic composite surfactant component selected from the group of surfactant molecules each of which comprises:

(C.1) a hydrophobic part; and (C.2) a hydrophilic part that has a composite structure that contains both (C.2.1) a nonionic moiety conforming to the general formula:

$$—(C_2H_4O)_n—,$$

where n is a positive integer with a value of at least two and (C.2.2) an anionic moiety.

2. A composition according to claim 1, wherein the amount of nonionic-anionic composite surfactant component (C) has a ratio by weight to the amount of hexavalent chromium ions component (A) that is from 0.1:1.0 to 2.0:1.0.

3. A composition according to claim 2 also comprising an amount of dissolved phosphate ions that has a weight ratio to the sum of the stoichiometric equivalents as chromium of the amounts of components (A) and (B) that is from 0.1:1.0 to 2.0:1.0.

4. A composition according to claim 3 also comprising an amount of dissolved fluorine-containing anions that has a ratio by weight to the sum of the stoichiometric equivalents as chromium of the amounts of components (A) and (B) that is from 0.01:1.0 to 1.0:1.0.

5. A composition according to claim 1 also comprising an amount of dissolved fluorine-containing anions that has a ratio by weight to the sum of the stoichiometric equivalents as chromium of the amounts of components (A) and (B) that is from 0.01:1.0 to 1.0:1.0.

6. A composition according to claim 3 also comprising dispersed silica particles having a size from 5 to 300 nm in an amount that has a ratio by weight to the sum of the stoichiometric equivalents as chromium of the amounts of components (A) and (B) that is from 0.2:1.0 to 6.0:1.0.

7. A composition according to claim 1 also comprising dispersed silica particles having a size from 5 to 300 nm in an amount that has a ratio by weight to the sum of the stoichiometric equivalents as chromium of the amounts of components (A) and (B) that is from 0.2:1.0 to 6.0:1.0.

8. A composition according to claim 7, wherein: the amounts of components (A) and (B) each has a stoichiometric equivalent as chromium; the stoichiometric equivalent as chromium of component (B) has a ratio to the stoichiometric equivalent as chromium of component (A) that is from 0.25:1.0 to 3.5:1.0; and the stoichiometric equivalents as chromium of components (A) and (B) have a sum that is from 1 to 100 g/L.

9. A process for chromate treatment of metal surfaces, said process comprising steps of:

(I) forming on the surface a liquid layer of a composition according to claim 8, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

10. A composition according to claim 4, wherein: the amounts of components (A) and (B) each has a stoichiometric equivalent as chromium; the stoichiometric equivalent as chromium of component (B) has a ratio to the stoichiometric equivalent as chromium of component (A) that is from 0.25:1.0 to 3.5:1.0; and the stoichiometric equivalents as chromium of components (A) and (B) have a sum that is from 1 to 100 g/L.

11. A composition according to claim 1, wherein: the amounts of components (A) and (B) each has a stoichiometric equivalent, as chromium; the stoichiometric equivalent as chromium of component (B) has a ratio to the stoichiometric equivalent as chromium of component (A) that is from 0.25:1.0 to 3.5:1.0; and the stoichiometric equivalents as chromium of components (A) and (B) have a sum that is from 1 to 100 g/L.

12. A process for chromate treatment of metal surfaces, said process comprising steps of:

(I) forming on the surface a liquid layer of a composition according to claim 4, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

13. A process for chromate treatment of metal surfaces, said process comprising steps of:

(I) forming on the surface a liquid layer of a composition according to claim 10, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

14. A process for chromate treatment of metal surfaces, said process comprising steps of:

(I) forming on the surface a liquid layer of a composition according to claim 7, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

15. A process for chromate treatment of metal surfaces, said process comprising steps of:

(I) forming on the surface a liquid layer of a composition according to claim 6, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

16. A process for chromate treatment of metal surfaces, said process comprising steps of:

(I) forming on the surface a liquid layer of a composition according to claim 5, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

17. A process for chromate treatment of metal surfaces, said process comprising steps of:

(I) forming on the surface a liquid layer of a composition according to claim 4, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

18. A process for chromate treatment of metal surfaces, said process comprising steps of:

(I) forming on the surface a liquid layer of a composition according to claim 3, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

19. A process for chromate treatment of metal surfaces, said process comprising steps of:

(I) forming on the surface a liquid layer of a composition according to claim 2, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

20. A process for chromate treatment of metal surfaces, said process comprising steps of:

(I) forming on the surface a liquid layer of a composition according to claim 1, said layer comprising an amount of chromium that is from 5 to 150 milligrams per square meter of surface treated; and (II) drying the layer formed in step (I) while it is still in contact with the surface being treated, so as to form on the surface a solid layer that is adherent to the surface and comprises all solid constituents of the liquid layer that remain chemically unreacted, solid products formed by chemical reaction between constituents of the liquid layer and the metal surface or chemical reaction between or among constituents of the liquid layer, or both such constituents and their reaction products.

* * * * *